US006891522B2

(12) United States Patent
Song et al.

(10) Patent No.: US 6,891,522 B2
(45) Date of Patent: May 10, 2005

(54) METHOD AND APPARATUS FOR DRIVING LIQUID CRYSTAL DISPLAY USING 2-DOT INVERSION SYSTEM

(75) Inventors: Hong-Sung Song, Kyoungsangbuk-do (KR); Sung-Woong Moon, Kyoungsangbuk-do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 307 days.

(21) Appl. No.: 09/894,786

(22) Filed: Jun. 29, 2001

(65) Prior Publication Data

US 2002/0084960 A1 Jul. 4, 2002

(30) Foreign Application Priority Data

Dec. 29, 2000 (KR) ..... 2000-85366

(51) Int. Cl.[7] ..... G09G 3/36
(52) U.S. Cl. ..... 345/87; 349/96; 349/204
(58) Field of Search ..... 345/87, 96, 90, 345/98, 94, 100, 204, 209, 213, 694–696

(56) References Cited

U.S. PATENT DOCUMENTS 5,648,793 A * 7/1997 Chen ..... 345/96
5,790,092 A * 8/1998 Moriyama ..... 345/96
6,327,008 B1 * 12/2001 Fujiyoshi ..... 349/106
6,342,876 B1 * 1/2002 Kim ..... 345/87
6,396,468 B2 * 5/2002 Matsushima et al. ..... 345/87
6,496,172 B1 * 12/2002 Hirakata ..... 345/96
6,512,505 B1 * 1/2003 Uchino et al. ..... 345/96
6,552,709 B1 * 4/2003 Yamaguchi ..... 345/99
6,570,553 B2 * 5/2003 Hashimoto et al. ..... 345/100
6,583,778 B1 * 6/2003 Nishimura et al. ..... 345/96
2001/0013852 A1 * 8/2001 Matsushima et al.

* cited by examiner

*Primary Examiner*—Regina Liang
*Assistant Examiner*—Jennifer T. Nguyen
(74) *Attorney, Agent, or Firm*—Morgan Lewis & Bockius LLP

(57) ABSTRACT

A method and apparatus of driving a liquid crystal display panel using a 2-dot inversion system is disclosed in the present invention. More specifically, a method of driving a liquid crystal display using a 2-dot inversion system includes the steps of sequentially pre-charging a plurality of pixel cells of the liquid crystal display panel along a plurality of gate lines, and sequentially charging the pixel cells with a plurality of data signals along the gate lines after pre-charging the pixel cells.

10 Claims, 9 Drawing Sheets

FIG. 2A
CONVENTIONAL ART

| | | | | | | |
|---|---|---|---|---|---|---|
| LC11 | + | − | + | − | + | − |
| LC21 | − | + | − | + | − | + |
| LC31 | + | − | + | − | + | − |
| LC41 | − | + | − | + | − | + |
| | + | − | + | − | + | − |
| | − | + | − | + | − | + |

FIG. 2B
CONVENTIONAL ART

| | | | | | | |
|---|---|---|---|---|---|---|
| LC11 | − | + | − | + | − | + |
| LC21 | + | − | + | − | + | − |
| LC31 | − | + | − | + | − | + |
| LC41 | + | − | + | − | + | − |
| | − | + | − | + | − | + |
| | + | − | + | − | + | − |

FIG. 4A
CONVENTIONAL ART

| | | | | | | |
|---|---|---|---|---|---|---|
| LC11 | + | − | + | − | + | − |
| LC21 | + | − | + | − | + | − |
| LC31 | − | + | − | + | − | + |
| LC41 | − | + | − | + | − | + |
| | + | − | + | − | + | − |
| | + | − | + | − | + | − |

FIG. 4B
CONVENTIONAL ART

| | | | | | | |
|---|---|---|---|---|---|---|
| LC11 | − | + | − | + | − | + |
| LC21 | − | + | − | + | − | + |
| LC31 | + | − | + | − | + | − |
| LC41 | + | − | + | − | + | − |
| | − | + | − | + | − | + |
| | − | + | − | + | − | + |

METHOD AND APPARATUS FOR DRIVING LIQUID CRYSTAL DISPLAY USING 2-DOT INVERSION SYSTEM

This application claims the benefit of Korean Application No. 10-2000-85366 filed on Dec. 29, 2000, which is hereby incorporated by reference.

BACKGROUND OF THE INVENTION

1. Field of the Invention

The present invention relates to liquid crystal display, and more particularly, to a method and apparatus for liquid crystal display wherein a liquid crystal display panel using a 2-dot inversion system. Although the present invention is suitable for a wide scope of applications, it is particularly suitable for minimizing a horizontal flickering noise.

2. Discussion of the Related Art

A liquid crystal display (LCD) controls transmissivity of light in liquid crystal cells on a liquid crystal display panel, thereby displaying an image corresponding to video signals. In order to drive the conventional art liquid crystal cells on the liquid crystal display panel, the LCD includes a liquid crystal display panel driving apparatus as shown in FIG. 1.

The liquid crystal display panel driving apparatus of FIG. 1 includes a data driving integrated circuit chip 12 (D-IC chip) for driving source lines SL1 to SLm on a liquid crystal display panel 10, a gate driving integrated circuit chip 14 (G-IC chip) for driving gate lines GL1 to GLn on the liquid crystal panel 10 and a gate start pulse generator GSP 15 for providing a gate start pulse to the gate driving integrated circuit chip 14. More specifically, the liquid crystal panel 10 includes a liquid crystal cell (LC) positioned at each pixel area divided by the source lines SL1 to SLm and the gate lines GL1 to GLn crossing each other, and a thin film transistor (TFT) positioned at each intersection between the source lines SL1 to SLm and the gate lines GL1 to GLn.

The thin film transistor TFT delivers a data signal on the source line SL into the liquid crystal cell LC when the gate line GL is enabled. Then, the liquid crystal cell LC charges an input data signal, via the thin film transistor TFT, from the source line SL and controls an amount if the transmitted light in accordance with a voltage level of the charged data signal.

In driving such a liquid crystal display, one of the following driving methods may be employed: a line inversion system, a column inversion system, a dot inversion system, a 2-dot inversion system, and a group inversion system.

In the dot inversion system, as shown in FIGS. 2A and 2B, polarities of the data signals applied to the liquid crystal display panel 10 are inverted every gate line GL with respect to the gate line GL on the liquid crystal display panel 10 and every source line SL with respect to the source line SL, and are inverted every frame on a time basis. In other words, in the method of driving a liquid crystal display panel using the dot inversion system, polarities of the data signals applied to the liquid crystal display panel 10 are inverted every source line SL and every gate line GL on the liquid crystal display panel 10, and every frame.

For instance, in the dot inversion system, polarity DSP of the data signal DS applied to the source line SL from the D-IC chip 12 is inverted every horizontal synchronization interval as shown in FIG. 3. Gate signals GS1 to GSn applied to the gate lines GL1 to GLn from the G-IC chip 14 are sequentially enabled for each horizontal synchronization interval. As shown in FIG. 3, pixel signals PS1 to PSn charged in each liquid crystal cell LC is changed into a voltage level of the data signal when the gate signal GS is enabled and thereafter remains at the changed voltage level until the gate signal GS is again enabled. In other words, each liquid crystal cell charges the data signal DL when the gate signal GS is enabled and maintains the charged voltage for one frame interval.

Such a dot-inversion driving method allows the liquid crystal cells to have the same charge condition. The identity of the charge condition can be explained by a pixel voltage charged in the adjacent liquid crystal cells in the vertical direction when the liquid crystal cells LC21 and LC31 positioned at the second and third gate lines GL2 and GL3 crossing the first source line SL1 are charged.

In the odd-numbered frames, as shown in FIG. 2A, the liquid crystal cell LC21 connected to the second gate line GL2 and the first source line SL1 is charged to a negative(−) data signal DS. At this time, the liquid crystal cell LC11 positioned at the upper side of the liquid crystal cell LC21 has a positive(+) voltage, and the liquid crystal cell LC31 positioned at the lower side of the liquid crystal cell LC21 has a positive(+) voltage. Meanwhile, the liquid crystal cell LC31 connected to the third gate line GL3 and the first source line SL1 is charged to a positive(+) data signal DS. The liquid crystal cell LC21 positioned at the upper side of the liquid crystal cell LC31 has a negative(−) voltage, and the liquid crystal cell LC41 positioned at the lower side of the liquid crystal cell LC31 has a negative(−) voltage.

In the even-numbered frames, as shown in FIG. 2B, when the liquid crystal cell LC21 connected to the second gate line GL2 and the first source line SL1 is charged to a positive(+) data signal DS, the liquid crystal cell LC11 positioned at the upper side of the liquid crystal cell LC21 has a negative(−) voltage, and the liquid crystal cell LC31 positioned at the lower side of the liquid crystal cell LC21 has a negative(−) voltage. On the other hand, the liquid crystal cell L31 connected to the third gate line GL3 and the first source line SL1 is charged a negative(−) data signal DS. In this case, the liquid crystal cell LC21 positioned at the upper side of the liquid crystal cell LC31 has a positive(+) voltage and the liquid crystal cell LC41 positioned at the lower side of the liquid crystal cell LC31 has a positive(+) voltage.

Since two liquid crystal cells vertically adjacent to the liquid crystal cell charged in this manner are always charged into voltages having an opposite polarity, all the liquid crystal cells have the same charge condition. Accordingly, a horizontal flicker does not appear at a picture displayed by the method driving the liquid crystal display panel using the dot inversion system.

In the 2-dot inversion system, as shown in FIGS. 4A and 4B, polarities of the data signals applied to the liquid crystal display panel 10 are inverted every two gate lines GL with respect to the gate line GL on the liquid crystal display panel 10 and every source line SL with respect to the source line SL, and are inverted every frame on a time basis. In other words, in a liquid crystal display panel driving method of the 2-dot inversion system, polarities of the data signals applied to the liquid crystal display panel 10 are inverted every source line SL and every two gate lines GL on the liquid crystal display panel 10, and every frame.

For instance, in the 2-dot inversion system, polarity DSP of the data signal DS applied to the source line SL from the D-IC chip 12 is inverted every two horizontal synchronization intervals as shown in FIG. 5. Gate signals GS1 to GSn applied to the gate lines GL1 to GLn from the G-IC chip 14 are sequentially enabled for each horizontal synchronization interval. As shown in FIG. 5, pixel signals PS1 to PSn charged in each liquid crystal cell LC is changed into a voltage level of the data signal when the gate signal GS is enabled and thereafter remains at the changed voltage level until the gate signal GS is again enabled. In other words, each liquid crystal cell is charged to the data signal DS when the gate signal GS is enabled and maintains the charged voltage for one frame interval.

Such a 2-dot inversion driving method allows the odd-numbered liquid crystal cells and the even-numbered liquid crystal cells to have a different charge condition. This phenomenon can be explained by a pixel voltage charged in the liquid crystal cells adjacent in the vertical direction when the liquid crystal cells LC21 and LC31 positioned at the second and third gate lines GL2 and GL3 crossing the first source line SL1 are charged.

In the odd-numbered frames, as shown in FIG. 4A, the liquid crystal cell LC21 connected to the second gate line GL2 and the first source line SL1 is charged to a positive(+) data signal DS. At this time, a positive(+) voltage has been charged to all of the liquid crystal cells LC11 and LC21. Meanwhile, the liquid crystal cell LC31 connected to the third gate line GL3 and the first source line SL1 is charged to a negative(−) data signal DS. At this time, a negative(−) voltage has been charged to all of the liquid crystal cells LC31 and LC41.

In the even-numbered frames, as shown in FIG. 4B, when the liquid crystal cell LC21 connected to the second gate line GL2 and the first source line SL1 is charged to a negative(−) data signal DS, a negative(−) voltage has been charged to all of the liquid crystal cells LC11 and LC21. On the other hand, the liquid crystal cell L31 connected to the third gate line GL3 and the first source line SL1 is charged to a positive(+) data signal DS. In this case, a positive(+) voltage has been charged to all of the liquid crystal cell LC31 and LC41.

In other words, the odd-numbered liquid crystal cells charge data signals having always the same polarity as voltages charged in two liquid crystal cells adjacent in the vertical direction. On the other hand, the even-numbered liquid crystal cells charge data signals having always the polarity contrary to voltages charged in two liquid crystal cells adjacent in the vertical direction. Accordingly, the odd-numbered liquid crystal cells are charged more slowly than the even-numbered liquid crystal cells.

For this reason, pixel voltages charged in the even-numbered liquid crystal cells fail to arrive at a voltage level of the data signal unlike the voltages charged in the odd-numbered liquid crystal cells. As a result, a picture displayed by the 2-dot inversion driving method generates a horizontal flicker noise.

SUMMARY OF THE INVENTION

Accordingly, the present invention is directed to a method and apparatus for driving a liquid crystal display using a 2-dot inversion system that substantially obviates one or more of problems due to limitations and disadvantages of the related art.

An object of the present invention is to provide a method and apparatus for driving a liquid crystal display panel using the 2-dot inversion system that is capable of minimizing a horizontal flicker noise.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method of driving a liquid crystal display using a 2-dot inversion system includes the steps of sequentially pre-charging a plurality of pixel cells of the liquid crystal display panel along a plurality of gate lines, and sequentially charging the pixel cells with a plurality of data signals along the gate lines after pre-charging the pixel cells.

In another aspect of the present invention, a method for driving a liquid display panel using a 2-dot inversion system includes the steps of applying signals having a polarity inverted every two gate lines to a plurality of source lines on the liquid crystal display, and applying a plurality of gate signals having a width of two horizontal synchronization intervals and overlapping each horizontal synchronization interval to each gate line on the liquid crystal display panel.

In another aspect of the present invention, a method for driving a liquid display panel using a 2-dot inversion system includes the steps of allowing a plurality of pixel cells arranged on the liquid crystal display panel to cross a plurality of source lines and gate lines each other to charge a voltage stored in the pixel cell on the preceding gate line and a data signal on the source line, and allowing the plurality of pixel cells to charge the data signal on the source line. allowing the plurality of pixel cells to charge the data signal on the source line.

In another aspect of the present invention, an apparatus for driving a liquid display panel employing a 2-dot inversion system includes a liquid crystal panel having a plurality of pixel cells arranged to cross a plurality of source lines and gate lines each other, a gate driver for applying a gate signal to each gate line such that pixel cells on the gate lines of the liquid crystal display panel sequentially charge data signals to each source line along the gate lines, and a double gate shift pulse generator charging the pixel cells prior to the charged data signal to the source line.

In a further aspect of the present invention, an apparatus for driving a liquid display panel employing a 2-dot inversion system includes a liquid crystal panel having a plurality of pixel cells arranged to cross a plurality of source lines and gate lines each other, a data driver applying a data signal to each source line on the liquid crystal display panel to have a polarity inverted every two gate lines, and a gate driver applying first gate signals having a width of two horizontal synchronization interval and overlapping each horizontal synchronization interval to the gate lines on the liquid crystal display panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings:

FIGS. 2A and 2B illustrate a polarity pattern of data signals applied to liquid crystal cells on a liquid crystal display panel by using a dot inversion method;

FIGS. 4A and 4B illustrate a polarity pattern of data signals applied to liquid crystal cells on a liquid crystal display panel by using a conventional 2-dot inversion method;

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 6A:
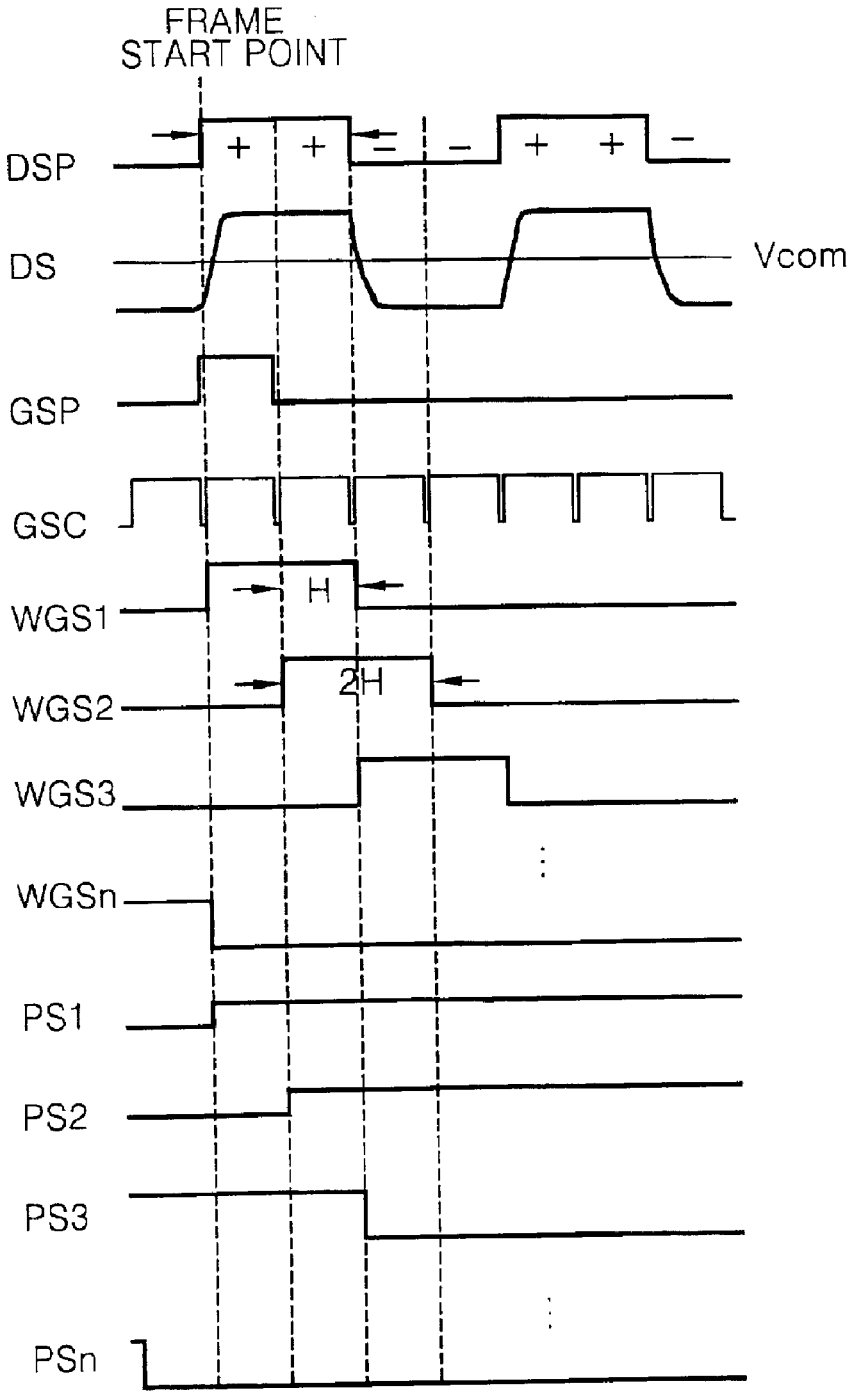
FIGS. 6A and 6B are waveform diagrams of signals applied to liquid crystal cells, gate lines and source lines on the liquid crystal display panel by using a 2-dot inversion method according to first and second embodiments of the present invention, respectively.
Figure 6B:
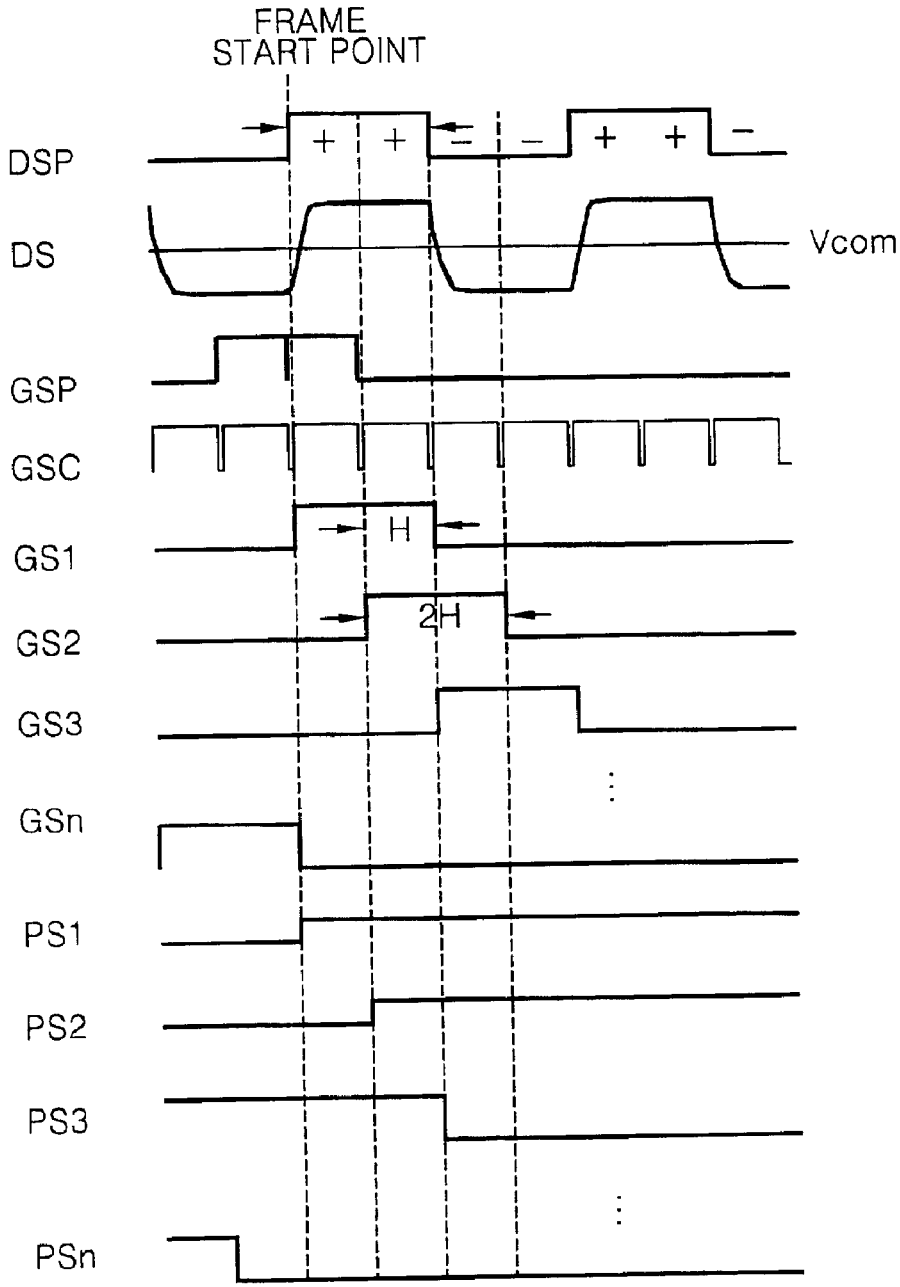

FIGS. 6A and 6B describe a liquid crystal display panel driving method of 2-dot inversion system according to first and second embodiments of the present invention. In FIGS. 6A and 6B, DS represents a data signal applied to a source line SL; GSP reresents a gate start purse indecated to a first driving gate line (i.e. first pixel line)in vertical scanning signal; GSC repeats a gate shift clock pulse applied to a G-IC chip; WGS1 to WGSn and GS1 to GSn are gate signals applied to n gate lines; and PS1 to PSn are pixel voltages charged in liquid crystal cells on a single of source line.

In the liquid crystal display panel driving method using a 2-dot inversion system according to first and second embodiments of the present invention, polarity of the data signal DS is inverted every two horizontal scanning intervals as shown in DSP of FIGS. 6A and 6B. Thus, a data signal DS in FIGS. 6A and 6B is applied to each of the odd-numbered source lines SL1, SL3, . . . , SLm−1 on the liquid crystal display panel while a data signal having a waveform opposite to a data signal DS in FIGS. 6A and 6B is applied to the even-numbered source lines SL2, SL4, . . . , SLm. Further, the liquid crystal cell is pre-charged. In other words, an enable interval of a certain gate line overlaps an enable interval of the preceding gate line. Thus, a gate signal applied to the gate line additionally have a pre-charge interval overlapping a signal charge interval of the preceding gate signal applied to the preceding gate line like WGS1 to WGSn and GS1 to GSn.

In the liquid crystal display panel driving method using a 2-dot inversion system according to first and second embodiments of the present invention, a pre-charge interval of a pre-charge interval is set to one horizontal scanning interval as shown in FIGS. 6A and 6B to enable a gate signal WGS or GS for two horizontal synchronization intervals. The gate signal GS is more enabled for a pre-charge interval corresponding to one horizontal synchronization interval such that the liquid crystal cells on the odd-numbered gate line and the liquid crystal cells on the even-numbered gate line have the same initial charge condition. For instance, a voltage charged in the liquid crystal cells on the liquid crystal display panel has a polarity as shown in FIG. 4A in the odd-numbered frame while having a polarity as shown in FIG. 4B in the even-numbered frame.

In the odd-numbered frame, the liquid crystal cell LC21 connected to the second gate line GL2 and the first source line SL1 is charged to two voltage signals having an opposite polarity (i.e., a positive(+) pixel voltage charged in the liquid crystal cell LC11 positioned at the upper side thereof and a negative(−) data signal DS applied to the liquid crystal cell LC11) for the pre-charge interval. Similarly, the liquid crystal cell LC31 connected to the third gate line GL3 and the first source line SL1 is charged to two voltage signals having an opposite polarity (i.e., a positive(+) pixel voltage having charged in the liquid crystal cell L21 positioned at the upper side thereof and a negative(−) data signal DS applied to the liquid crystal cell LC21) for the pre-charge interval.

In the even-numbered frame, the liquid crystal cell LC21 connected to the second gate line GL2 and the first source line SL1 is charged to two voltage signals having an opposite polarity (i.e., a negative(−) pixel voltage charged in the liquid crystal cell LC11 positioned at the upper side thereof and a positive(+) data signal DS applied to the liquid crystal cell LC11) for the pre-charge interval. Similarly, the liquid crystal cell LC31 connected to the third gate line GL3 and the first source line SL1 charges two voltage signals having a mutually contrary polarity (i.e., a negative(−) pixel voltage having charged in the liquid crystal cell L21 positioned at the upper side thereof and a positive(+) data signal DS applied to the liquid crystal cell LC21) for the pre-charge interval.

As described above, all of the liquid crystal cells on the odd-numbered and even-numbered gate line charge two voltage signals having a mutually opposite polarity, so that all of the odd-numbered and even-numbered liquid crystal cell have the same initial charge condition upon charging of a signal. Also, the odd-numbered and even-numbered liquid crystal cells have a pixel voltage changed in such a manner to be proximate to a common voltage level in the pre-charge interval.

Accordingly, the odd-numbered liquid crystal cells charging a data signal having a polarity opposite to a pixel voltage charged in two liquid crystal cells adjacent to each other in the vertical direction will have a high enough voltage level of the data signal. As a result, even though a data signal having the same voltage level is applied to the liquid crystal cells on the source lines, the liquid crystal cells keep the same displacement angle to prevent a generation of the flicker noise in the horizontal direction of the liquid crystal.

Figure 7A:
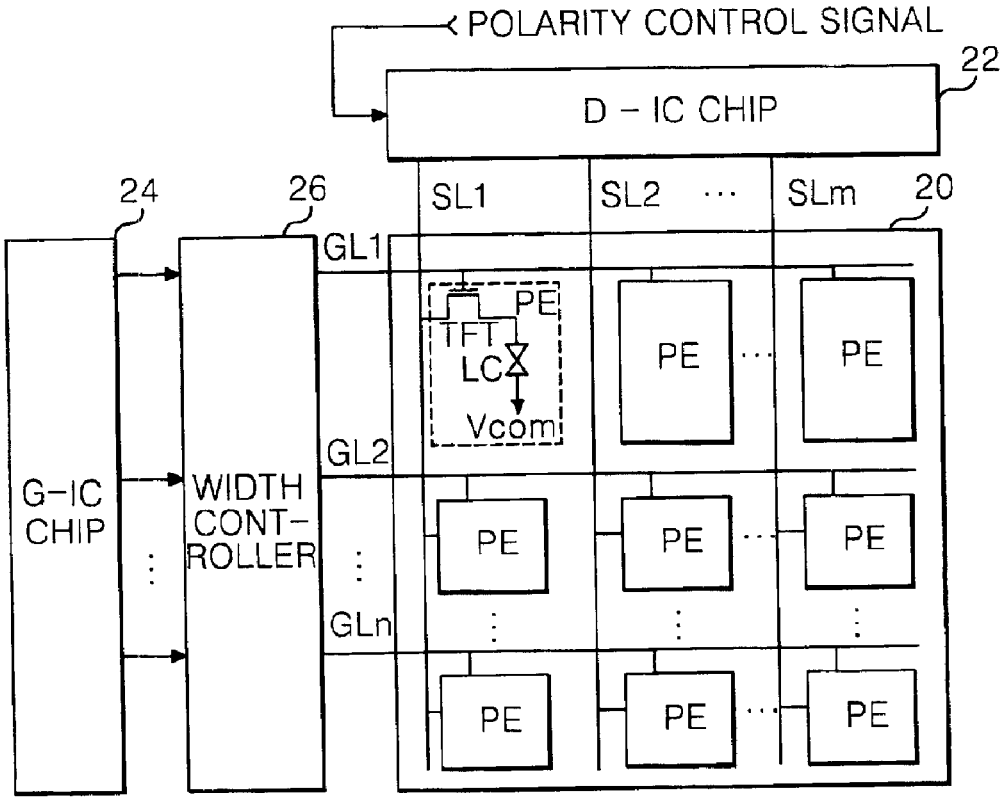
FIGS. 7A and 7B are schematic block circuit diagrams illustrating a liquid crystal display panel driving apparatus using the 2-dot inversion method according to the first and second embodiments of the present invention, respectively.
Figure 7B:
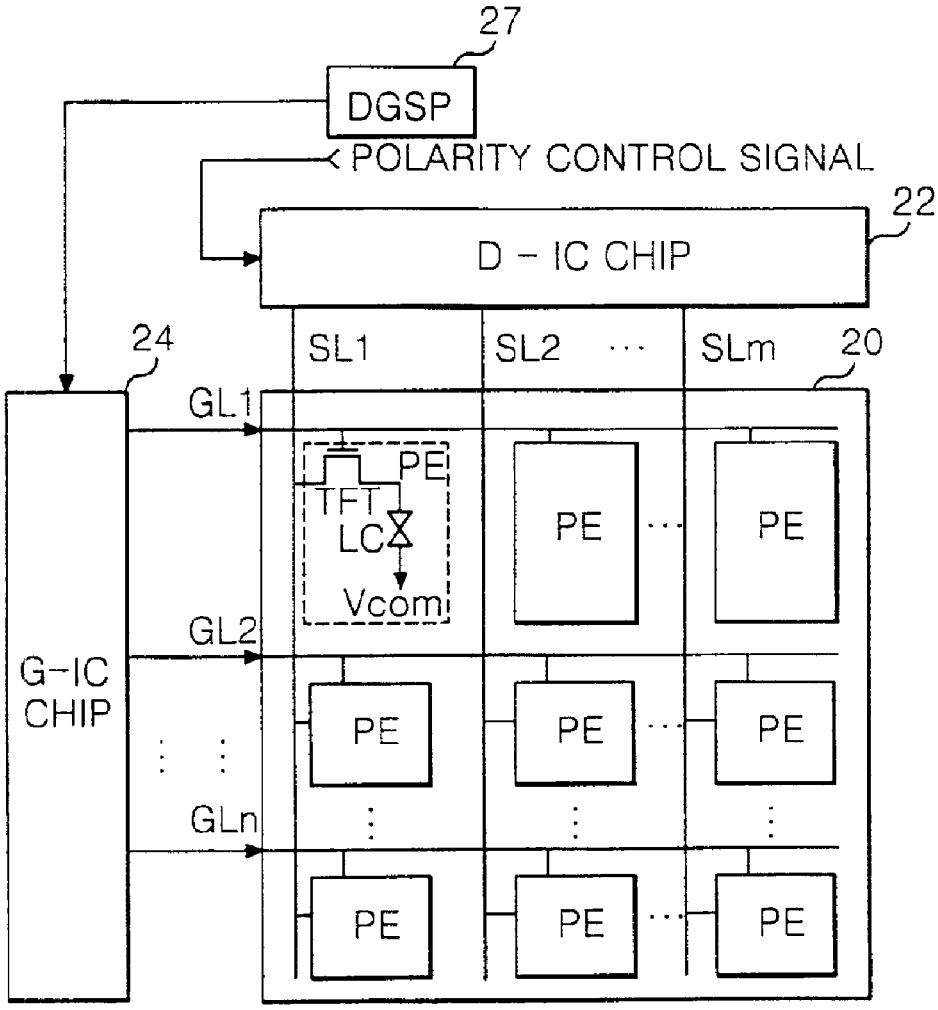

FIGS. 7A and 7B are schematic block circuit diagrams illustrating a liquid crystal display panel driving apparatus using a 2-dot inversion system according to first and second embodiments of the present invention, respectively.

As shown in FIGS. 7A and 7B, the liquid crystal display panel driving apparatus according to first and second embodiments of the present invention, includes a D-IC chip 22 for driving source lines SL1 to SLn on a liquid crystal display panel 20, and a G-IC chip 24 for driving gate lines GL1 to GLn arranged in such a manner to cross the source lines SL1 to SLm. The liquid crystal display panel 20 has pixels PE each of which is arranged at each area divided by the gate lines GL1 to GLn and the source lines SL1 to SLm.

Each pixel PE includes a liquid crystal cell LC responding to electric fields (i.e., a data signal) to control transmitted light quantity, and a thin film transistor TFT responding to a gate signal on the gate line GL to selectively connect the source line SL to the liquid crystal cell LC.

More specifically, the D-IC chip 22 responds to a source control signal from a timing controller (not shown) to apply a pixel data signal for one line to the source lines SL1 to SLm whenever the gate line GL is enabled. At this time, a pixel data signal for one line has a polarity opposite to the adjacent pixel data signals. In other words, the D-IC chip 22 allows a pixel data signal for one line to have a polarity inverted repetitively in accordance with the pixel (or the source line). A pixel data signal outputted to the D-IC chip 22 has a polarity inverted every two gate lines GL like the data signal DS shown in FIG. 6A.

Further, the D-IC chip 22 responds to a polarity control signal from the timing controller to invert a polarity pattern of data signals applied to the pixels on the gate lines GL every frame. To this end, the polarity control signal applied to the D-IC chip 22 has a waveform inverted every frame.

Figure 1:
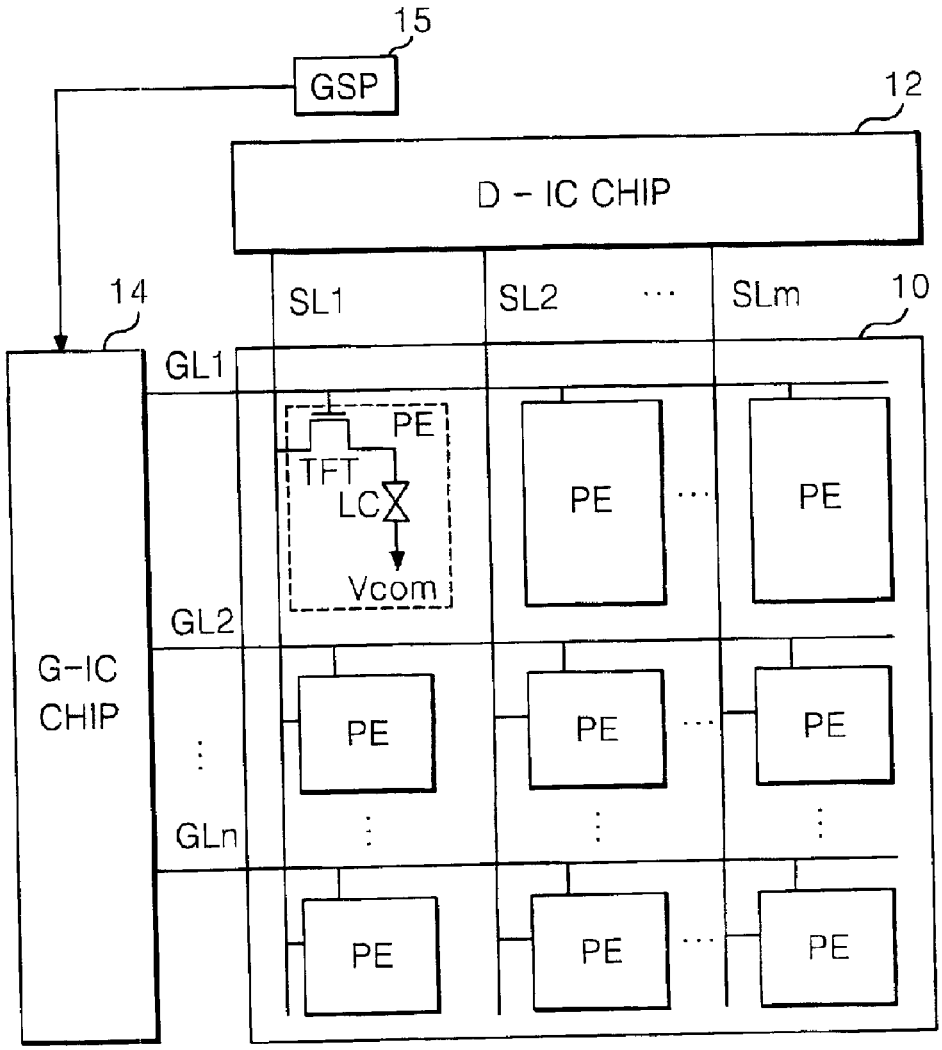
FIG. 1 CONVENTIONAL ART
FIG. 1 is a schematic block circuit diagram illustrating a conventional art liquid crystal display panel driving apparatus.
Figure 3:
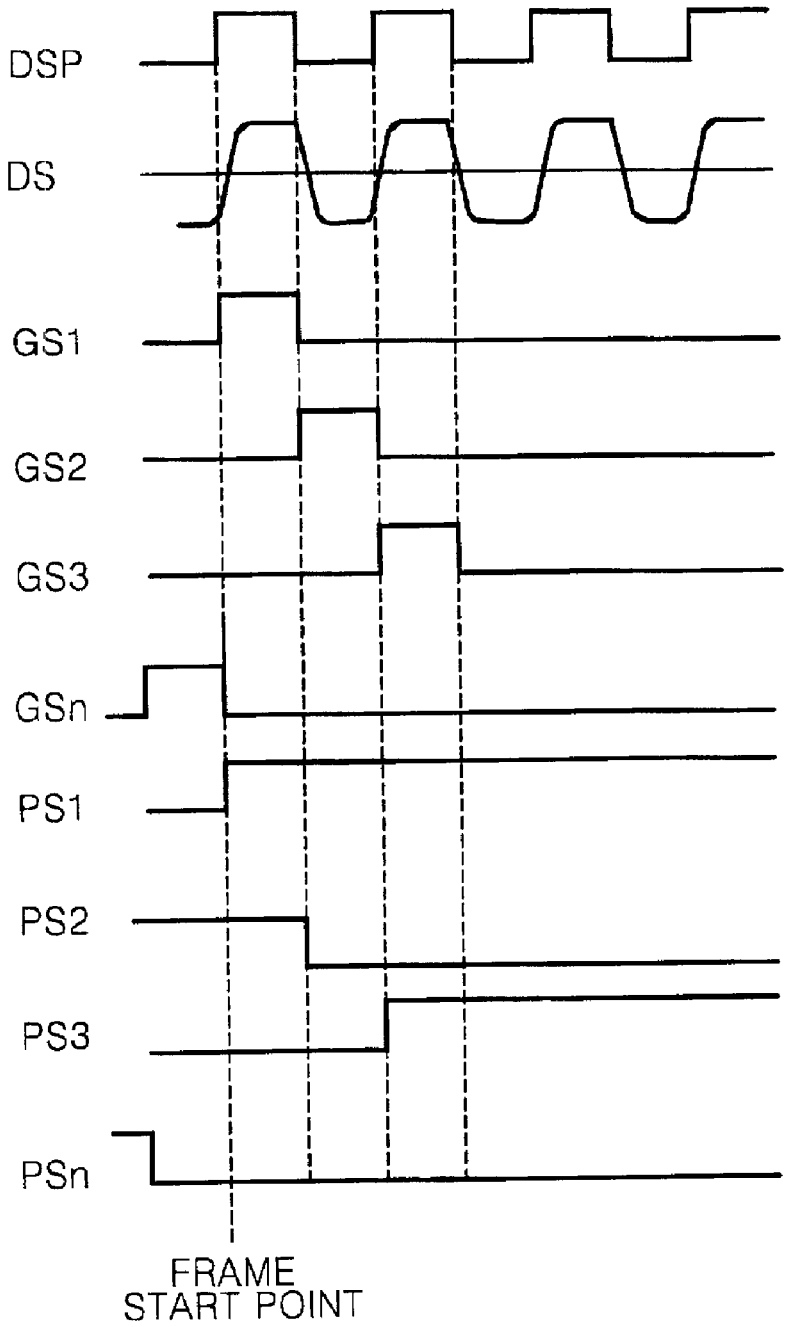
FIG.3 CONVENTIONAL ART
FIG. 3 is a waveform diagram of signals applied to liquid crystal cells, gate lines and source lines on the liquid crystal display panel by using the dot inversion method.
Figure 5:
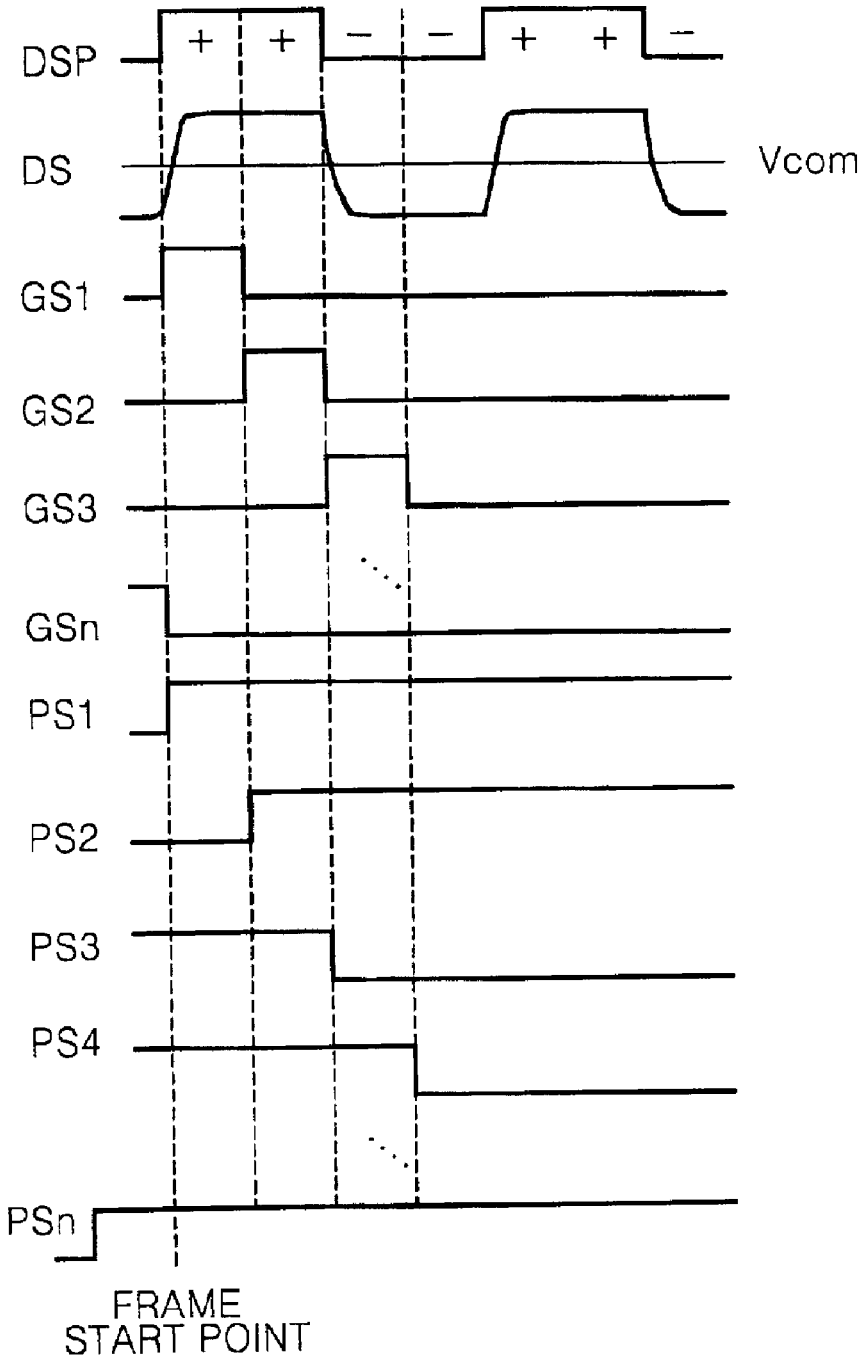
FIG.5 CONVENTIONAL ART
FIG. 5 is a waveform diagram of signals applied to liquid crystal cells, gate lines and source lines on the liquid crystal display panel by the conventional 2-dot inversion method.

The G-IC chip 22 responds to a gate start purse GSP and gate shift clock GSC from a timing controller and generates n gate signals GS1 to GSn for driving sequentially by 1 horizontal synchronization interval every frame. The N gate signals(GS1 to GSn) are sequentially enabled by each horizontal synchronization interval as shown in FIGS. 3 and 5.

The liquid crystal display panel driving apparatus according to first embodiment of the present invention, further includes a width controller 26 connected between the gate lines GL1 to GLn on the liquid crystal display panel 20 and the G-IC chip 24. The width controller 26 enlarges widths of the gate signals GS1 to GSn to be applied from the G-IC chip 24 to the gate lines GL. Thus, the gate signals GS1 to GSn outputted from the G-IC chip 24 are changed into width-controlled gate signals WGS1 to WGSn additionally having a pre-charge interval overlapping a signal charge interval of the preceding gate signal applied to the preceding gate line like the signals GS1 to GSn in FIG. 6A.

By the width controller 26, liquid crystal cell is previously charged. In other words, the width controller 26 allows the first half of an enabled period at a gate line GL to be overlapped with the latter half of enabled period of the previous gate line GL. Such the width controller 26 allows the varied signal WGS to be enabled more a pre-charging period corresponding to one horizontal synchronization interval, so that liquid crystal cell on the odd-numbered gate line is equal to liquid crystal cell on the even-numbered gate line in a charging condition.

To this end, the width controller 26 includes n logical gates. Although OR gates are used as the logical gates in the liquid crystal display panel driving apparatus according to the first embodiment of the present invention, AND gates, NOR gates or NAND gates may be used depending on a logical value at which the gate signals GS and the width-controlled gate signals WGS are enabled. Each OR gate carries out an OR operation of two gate signals GS applied to two adjacent gate lines GL to generate a width-controlled gate signal WGS. The first OR gate generating the first width-controlled gate signal WGS1 to be applied to the first gate line GL1 performed an OR operation of the gate signal GSn to be applied to the nth gate line GLn and the gate signal GS1 to be applied to the first gate line GL1.

Also, in the liquid crystal display driving apparatus using 2-dot inversion system according to the second embodiments of the present invention, the liquid crystal cell may be pre-charged by a dual gate start pulse DGSP 27 without the width controller 26. For example, the G-IC chip 22 responds to a double gate start pulse DGSP (not shown) to generate n gate signals GS1 to GSn for sequentially driving n gate lines GL1 to GLn for each horizontal synchronization interval every frame, as shown in FIG. 6B. Each of the n gate signals GS1 to GSn has a waveform sequentially enabled for each horizontal synchronization interval as shown in FIG. 3 and FIG. 5.

A corresponding waveform diagram for the second embodiment is illustrated in FIG. 6B. As shown in the drawing, the dual gate start pulse DGSP is indicated as a doubled width compared to GSP of FIG. 6A. In other words, the first half of an enable interval of a certain gate line GL overlaps the second half of an enable interval of the preceding gate line.

Thus, the dual gate start pulse DGSP allows the changed gate signal GS to be more enabled by a pre-charge interval corresponding to one horizontal synchronization interval, so that the liquid crystal cells on the odd-numbered gate lines and the liquid crystal cells on the even-numbered gate lines have the same initial charge condition. For instance, a voltage charged in the liquid crystal cells on the liquid crystal display panel has a polarity as shown in FIG. 4A in the odd-numbered frame while having a polarity as shown in FIG. 4B in the even-numbered frame.

In the odd-numbered frame, the liquid crystal cell LC21 connected to the second gate line GL2 and the first source line SL1 is charged to two voltage signals having an opposite polarity (i.e., a positive(+) pixel voltage charged in the liquid crystal cell LC11 positioned at the upper side thereof and a negative(−) data signal DS applied to the liquid crystal cell LC11) for the pre-charge interval. Similarly, the liquid crystal cell LC31 connected to the third gate line GL3 and the first source line SL1 is charged to two voltage signals having an opposite polarity (i.e., a positive(+) pixel voltage having charged in the liquid crystal cell L21 positioned at the upper side thereof and a negative(−) data signal DS applied to the liquid crystal cell LC21) for the pre-charge interval.

In the even-numbered frame, the liquid crystal cell LC21 connected to the second gate line GL2 and the first source line SL1 is charged to two voltage signals having an opposite polarity (i.e., a negative(−) pixel voltage having charged in the liquid crystal cell LC11 positioned at the upper side thereof and a positive(+) data signal DS applied to the liquid crystal cell LC11) for the pre-charge interval. Similarly, the liquid crystal cell LC31 connected to the third gate line GL3 and the first source line SL1 is charged two voltage signals having an opposite polarity (i.e., a negative (−) pixel voltage having charged in the liquid crystal cell L21 positioned at the upper side thereof and a positive(+) data signal DS applied to the liquid crystal cell LC21) for the pre-charge interval.

All of the liquid crystal cells on the odd-numbered and even-numbered gate line charge two voltage signals having a mutually opposite polarity in that manner, so that all of the odd-numbered and even-numbered liquid crystal cell have the same initial charge condition upon charging of a signal. Also, the odd-numbered and even-numbered liquid crystal cells have a pixel voltage changed in such a manner to be proximate to a common voltage level in the pre-charge interval.

Accordingly, the odd-numbered liquid crystal cells charging a data signal having a polarity opposite to a pixel voltage charged in two liquid crystal cells adjacent to each other in the vertical direction will have a high enough voltage level of the data signal. As a result, even though a data signal having the same voltage level is applied to the liquid crystal cells on the source lines, the liquid crystal cells keep the same displacement angle to prevent a generation of the flicker noise in the horizontal direction of the liquid crystal.

As described above, according to the present invention, the first half of the gate signal applied to the gate line on the liquid crystal display panel and the second half of the preceding gate signal are enabled at the same time, thereby pre-charging the liquid crystal cells on the gate lines. Accordingly, since the liquid crystal cells on the respective gate lines have the same initial charge condition, the pixel voltages charged in the liquid crystal gate lines have a high enough voltage level of the data signal. As a result, the liquid crystal cells have the same displacement angle with respect to the same data signal to prevent a generation of the horizontal flicker.

It will be apparent to those skilled in the art that various modifications and variations can be made in the method and apparatus of driving a liquid crystal display using a 2-dot inversion system of the present invention without departing from the spirit or scope of the inventions. Thus, it is intended that the present invention covers the modifications and variations of this invention provided they come within the scope of the appended claims and their equivalents.

What is claimed is:

1. A method of driving a liquid crystal display panel using a 2-dot inversion system, the method comprising the steps of:

applying a gate start pulse to a gate driver, the gate driver applying gate signals to a plurality of gate lines;

sequentially pre-charging a plurality of pixel cells of the liquid crystal display panel along the plurality of gate lines; and sequentially charging the pixel cells with a plurality of data signals along the gate lines after pre-charging the pixel cells, wherein the sate start pulse has the same width as that of the gate signals and is overlapped with a first one of the gate signals.

2. The method as claimed in claim 1, wherein the pre-charging step is carried out when the pixel cells on the preceding gate line charges the data signal.

3. The method as claimed in claim 1, wherein the pre-charging step is carried out at the time interval the same as the data signal charging step.

4. A method of driving a liquid crystal display panel using a 2-dot inversion system, the method comprising the steps of:

applying signals having a polarity inverted every two gate lines to a plurality of source lines on the liquid crystal display panel; and applying a gate start pulse and a plurality of gate signals having a width of two horizontal synchronization intervals and overlapping each horizontal synchronization interval to each gate line on the liquid crystal display panel, wherein the gate start pulse has the same width as that of the gate signals and is overlapped with a first one of the gate signals.

5. A method of driving a liquid crystal display panel using a 2-dot inversion system, the method comprising the steps of:

receiving a gate start pulse and outputting gate signals;

allowing a plurality of pixel cells arranged on the liquid crystal display panel to cross a plurality of source lines and gate lines each other to charge a voltage stored in the pixel cell on the preceding gate line and a data signal on the source line in response to the gate signals; and allowing the plurality of pixel cells to charge the data signal on the source line in response to the gate signals, wherein the gate start pulse has the same width as the gate signals and is overlapped with a first one of the gate signals.

6. An apparatus for driving a liquid crystal display panel employing a 2-dot inversion system, comprising:

a liquid crystal panel having a plurality of pixel cells arranged to cross a plurality of source lines and gate lines each other;

a gate driver for applying a gate signal to each gate line such that pixel cells on the gate lines of the liquid crystal display panel sequentially charge data signals on each source line along the gate lines; and a dual gate start pulse generator generating a gate start pulse and pre-charging the pixel cells prior to charging data signals on the source line, wherein the gate start pulse has the same width as that of the gate signals and is overlapped with a first one of the gate signals.

7. The apparatus as claimed in claim 6, wherein the dual gate start pulse generator pre-charges the pixel cells when the pixel cell on the preceding gate line charges the data signal.

8. The apparatus as claimed in claim 7, wherein the dual gate start pulse generator allows the pixel cells to carry out the pre-charging in a time interval equal to an interval for charging the data signal.

9. An apparatus for driving a liquid crystal display panel employing a 2-dot inversion system, comprising:

a liquid crystal panel having a plurality of pixel cells arranged to cross a plurality of source lines and gate lines each other;

a data driver applying a data signal to each source line on the liquid crystal display panel to have a polarity inverted every two gate lines;

a gate driver applying gate signals having a width of two horizontal synchronization interval and overlapping each horizontal synchronization interval to the gate lines on the liquid crystal display panel; and a gate start pulse generating portion to output a gate start pulse to a gate driver, wherein the gate start pulse has the same width of the gate driver and is overlapped with a first one of the gate signals.

10. The apparatus as claimed in claim 9, wherein the gate driver includes:

a gate driving integrated circuit chip applying a plurality of first gate signals to the gate lines, wherein the first gate signals have a width of one horizontal synchronization interval and sequentially enabled therein; and a width controller connected to the gate driving integrated circuit chip and the gate lines and executing a logical operation of each of the first gate signals and each of second gate signals to be applied to the preceding gate line, thereby generating the first gate signals.

* * * * *